US005318056A

United States Patent [19]

Kusz et al.

[11] Patent Number: 5,318,056

[45] Date of Patent: Jun. 7, 1994

[54] SOLVENT RECIRCULATING TYPE SPRAY GUN CLEANER

[75] Inventors: John P. Kusz, Chicago; John C. Justice, Elburn, both of Ill.

[73] Assignee: Safety-Kleen Corporation, Elgin, Ill.

[21] Appl. No.: 33,168

[22] Filed: Mar. 16, 1993

Related U.S. Application Data

[63] Continuation of Ser. No. 841,895, Mar. 20, 1986, Pat. No. 5,213,119.

[51] Int. Cl.[5] ..... B08B 3/02

[52] U.S. Cl. ..... 134/95.3; 134/99.1; 134/103.2; 134/166 R

[58] Field of Search ..... 134/56 R, 103.1, 95.3, 134/99.1, 103.2, 94.1, 111, 109, 108, 166 R, 200, 198, 174

[56] References Cited

U.S. PATENT DOCUMENTS

| | | | |
|---|---|---|---|
| 2,675,012 | 4/1954 | Scales | 134/99.1 |
| 3,343,555 | 9/1967 | Kasner | 134/111 |
| 3,378,019 | 4/1968 | Riolo et al. | 134/111 |
| 3,970,560 | 7/1976 | Metzger | 134/111 |
| 4,051,858 | 10/1977 | Mele | 134/111 |
| 4,402,331 | 9/1983 | Taldo et al. | 134/58 R |
| 4,433,698 | 2/1984 | Blaul | 134/103.1 |
| 4,464,256 | 8/1984 | Plourde | 134/111 |
| 4,601,300 | 7/1986 | Sundheimer | 134/95.3 |

*Primary Examiner*—Frankie L. Stinson

*Attorney, Agent, or Firm*—James T. FitzGibbon; Angelo J. Bufalino

[57] ABSTRACT

A recirculating type cleaner for paint spray guns. The apparatus includes a cabinet supporting a sink and a pair of solvent receptacles each containing a pump and motor for circulating solvent from the receptacles through outlet nozzles and into the sink. In use, the gun is given one or more initial rinses with solvent, from one receptacle, after which a final cleaning rinse is made with new solvent from another receptacle. The sink drain is arranged so that all of the solvent is returned to a single container. Clean solvent passes in use from the clean solvent receptacle to the used or dirty solvent receptacle, leaving fresh solvent uncontaminated, while the contaminated solvent is used repeatedly. The sink includes a fire safety cover secured over the sink opening by a fusible link, and the solvent receptacles are positioned for ready removal to facilitate periodic servicing.

9 Claims, 2 Drawing Sheets

FIG. 1
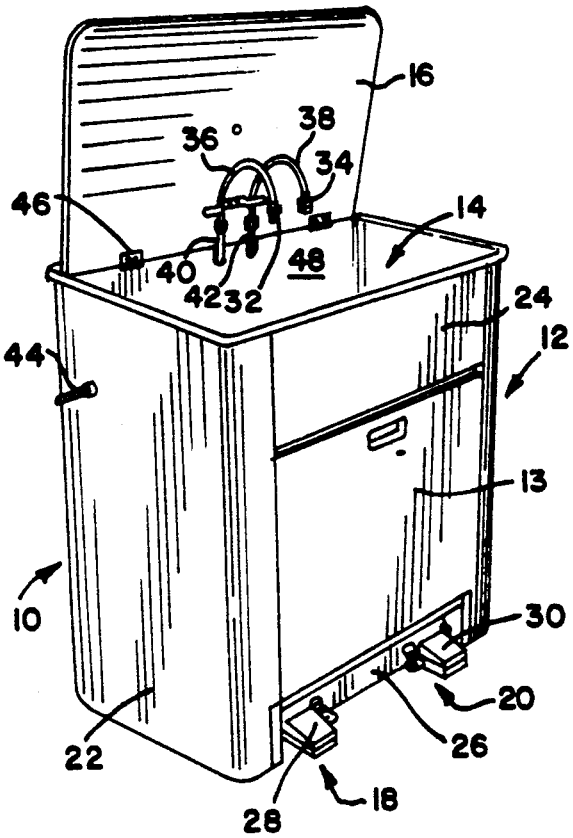
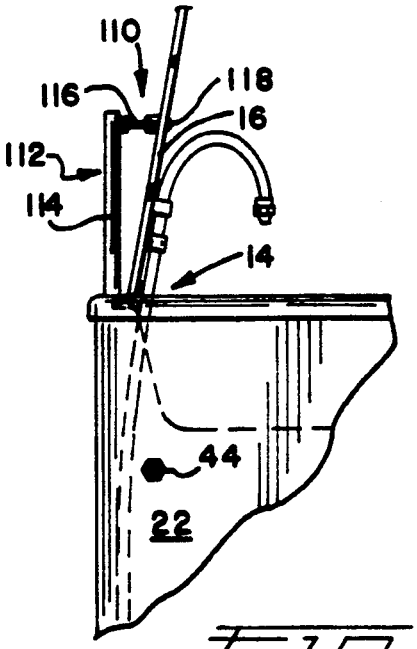
FIG. 4
FIG. 3
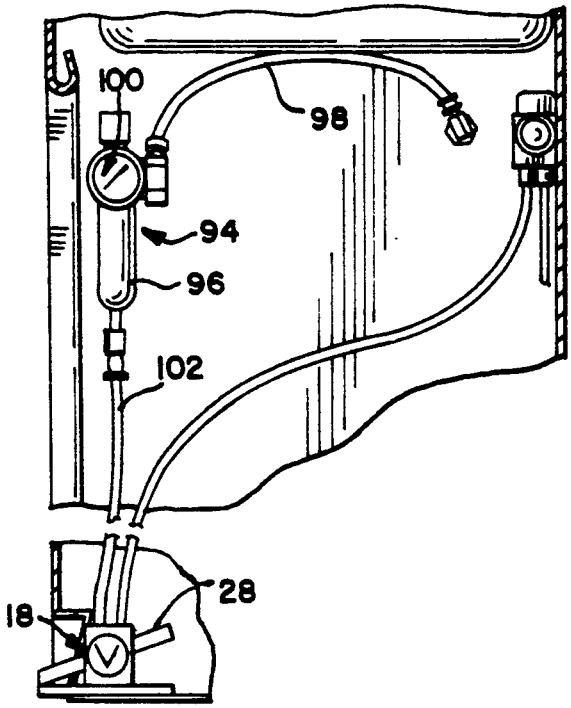

SOLVENT RECIRCULATING TYPE SPRAY GUN CLEANER

This application is a continuation of application Ser. No. 841,895, filed Mar. 20, 1986, now U.S. Pat. No. 5,213,119.

The present invention relates generally to apparatus for industrial cleaning, and more particularly, to a cleaning apparatus adapted for use in cleaning spray guns used in the application of paints, resins, and other hardenable coating materials whose residues must be periodically removed from the spray gun with the aid of solvent during use.

While the most familiar form of such apparatus is a simple paint spray gun, it is understood that other forms of apparatus may be cleaned with the use of the present invention, and that such uses are comprehended within the scope of the present invention.

As is known to those skilled in the art, application of coatings by spraying involves the use of a gun which has a body which further includes at least one inlet for pressurized air, an outlet nozzle, and a paint reservoir in the form of a detachable can or "cup". Where complex material such as catalyzed paints are used, or two component systems are involved, there may be plural inlets to the gun body, and a more complex passage system therein.

In any case, after use of an apparatus of the type in question, it is required that the unit be cleaned thoroughly before being taken out of service for a greater or less length of time. Customarily, the spray painter pours any paint remaining in the cup back into a container for retention and re-use, or disposal, and rinses the spray cup with solvent. Thereafter, the cup may be completely or partially filled with solvent, and the gun, while still attached to the air connection, is operated intermittently so as to loosen paint residue remaining in the interior of the gun body and the paint spray nozzle. Thereafter, the gun may be partially disassembled for further cleaning; however, if the gun is to be used again soon, it is merely re-rinsed one or more times with solvent, and after clear solvent passes therethrough, the gun is considered ready for further operation. Sometimes, final clean-up involves the use of clean solvent, while initial cleaning is done with old solvent.

One drawback in cleaning paint and like coating guns is that the use of solvent is both expensive and hazardous. While lacquer thinner or similar solvents are effective for their intended purpose, they are relatively expensive. Where, as in most cases, the solvents serve as thinners for the paint, they are highly volatile and inhalation of solvent vapors is detrimental to the health of the user. Use of solvent for gun cleaning is therefore advantageously controlled carefully, both as a matter of complying with existing environmental and employee safety regulations, as well as in general pursuit of on the job safety.

Referring to the matter of cost, it is known that the use of excessive solvent in cleanup operations is simply wasteful and expensive, whereas the use of insufficient solvent creates problems of ineffective cleanup.

The common practice of using solvent which has already been dirtied or contaminated, especially when working with different colors, is a facet of the same problem; in other words, to avoid the expense of clean solvent, certain amounts of previously used solvent may be employed in the clean up operation. This in turn creates difficulty in determining the point at which the solvent in question is too contaminated for further use.

In view of the expense of solvents and thinners used for this purpose, and the requirement for complying with safety and related regulations in the work place, there has existed a significant need for a cleaning apparatus which would be particularly directed to cleaning spray coating guns, and which would provide a number of advantages in use.

These include the ability to use both "dirty" or used solvent as well as clean solvent, to control the flow of such solvent so as to minimize use of new solvent, to obtain the most effective use of the existing solvent, to protect the user against generation of undue vapors presenting an inhalation hazard, and in another important aspect, to provide a spray gun cleaner apparatus which is capable of being serviced by an outside agency.

In this last connection, it has been realized that there are many economic benefits to be gained by the provision of serviceable parts washers. A parts washer of the type described and claimed in U.S. Pat. No. 3,522,814 has proved extremely successful in commercial and industrial use, as being the first parts washer which was capable of being readily and simply serviced on the premises of the user. When the economics of periodic parts washer service, combined with safety, good performance, and very importantly, the potential for effective solvent recycling, became known to the industry, demand increased sharply for parts washers of this type, and it is no exaggeration to say that a whole new industry was founded, based on this concept. According to the present invention, it is desired to provide a serviceable solvent type gun cleaner which will make the economies of an outside gun cleaning service, including the potential for economic savings through recycling, available to the commercial and industrial user of equipment of this type.

In view of the failure of the prior art to provide an apparatus for cleaning spray guns having the advantages and characteristics referred to herein, it is an object of the present invention to provide an improved spray gun cleaning apparatus.

Another object of the invention is to provide a spray gun cleaner which employs separate reservoirs of solvent, one for previously unused solvent and another for previously employed or "used" solvent.

A further object of the invention is to provide a spray gun cleaner unit which uses separate solvent circulating systems, and which maintains two separate reservoirs of solvent in a storage position in place within the cabinet of the unit.

A still further object of the invention is to provide a spray gun cleaner unit which is especially adapted to be readily serviced by a single man in a matter of a few minutes or less, which makes recycling potential available to the user, and which does not require great mechanical skill in carrying out the service operation.

Yet another object of the invention is to provide a method of cleaning spray guns which involves providing two solvent containers of preferably equal capacity, with solvent from the "dirty" solvent container being recirculated as desired, and with solvent from the new solvent container being used for final cleaning in its first use, and for recirculation thereafter.

Another object of the invention is to provide a spray gun cleaning system which includes a cabinet supporting a sink, a safety cover over the sink, a cabinet area for positioning two solvent receptacles, and a pair of air operated motors and associated foot controls for circulating the solvent to outlets within the sink, and wherein all solvent directed to the sink is returned to a single receptacle.

Yet another object of the invention is to provide a method of servicing a spray gun cleaning apparatus on a periodic basis, and a method of operating the apparatus in use.

The foregoing and other objects and advantages of the invention are carried into practice by providing an apparatus which includes a sink, a cabinet, at least two solvent receptacles, a pump and control system for each receptacle, and an arrangement whereby all solvent is returned to a single container, regardless of the receptacle from which it is taken.

The manner in which the foregoing and other objects and advantages of the present invention are attained in practice will become more clearly apparent when reference is made to the accompanying detailed description of the preferred embodiments of the invention set forth by way of example, and shown in accompanying drawings wherein like reference numbers indicate corresponding parts throughout.

BRIEF DESCRIPTION OF THE DRAWINGS

FIG. 1 is a perspective view of the spray gun cleaner apparatus of the invention;

FIG. 3 is a fragmentary vertical sectional view, with portions broken away, and taken along lines 3—3 of FIG. 2 and showing parts of the fluid flow control valve assemblies of the invention; and FIG. 4 is a fragmentary sectional view of an upper, portion of the cabinet, showing the releasable attachment of the safety cover to the cover holder by means of a fusible link.

DESCRIPTION OF THE PREFERRED EMBODIMENTS OF THE INVENTION

Figure 2:
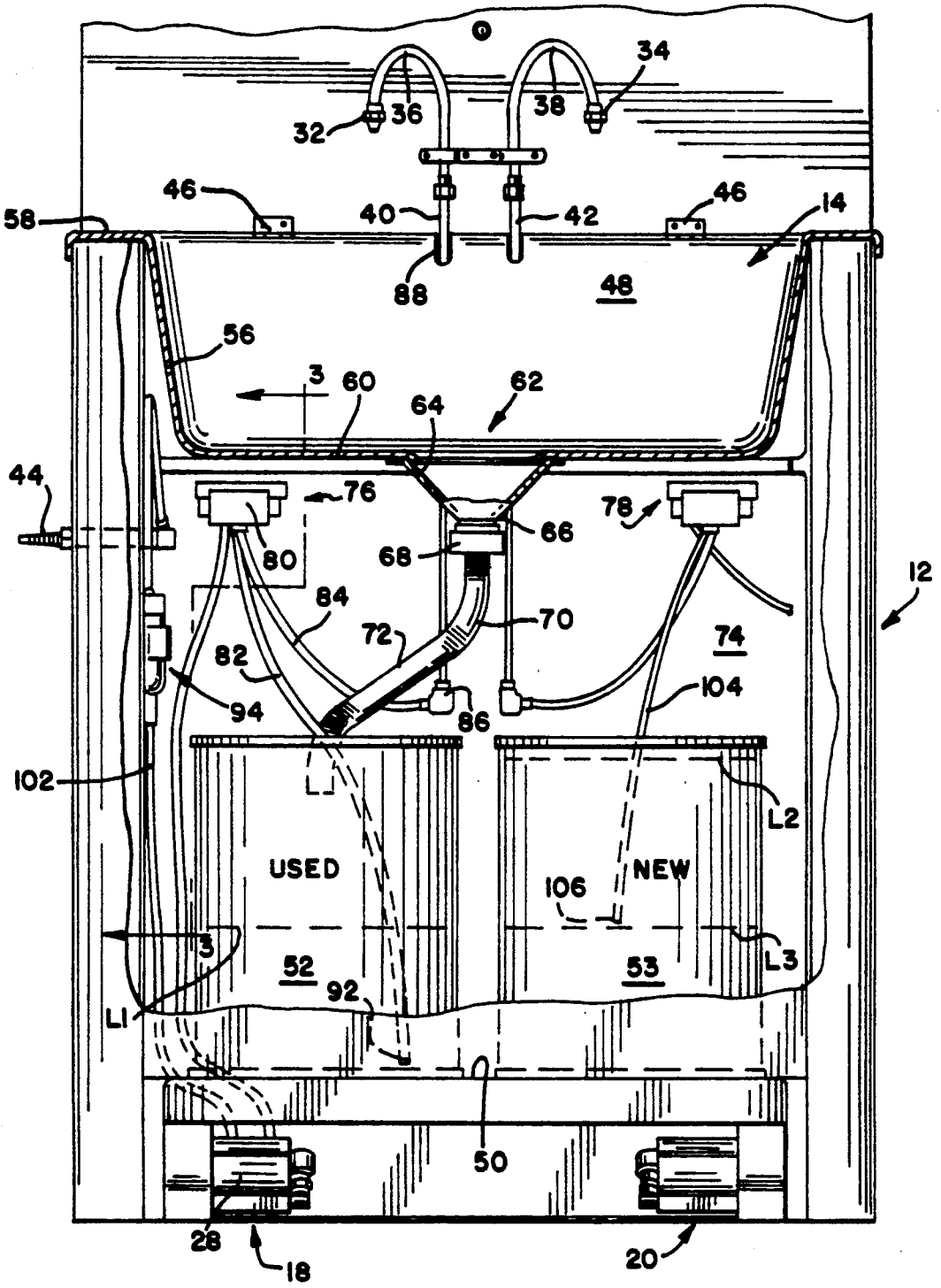
FIG. 2 is an enlarged front view, partly in elevation and partly in section, and showing major elements of the spray gun cleaner apparatus of the invention.

While the gun cleaner apparatus of the invention may be embodied in different forms, a preferred form of apparatus will be described wherein the apparatus uses a single cabinet supporting a sink, with plural solvent containers received in the cabinet, and wherein the pump controls are foot-operated and serve to control the flow of air to pumps and motors which provide the circulating action.

Referring now to the drawings in greater detail. FIG. 1 shows the gun cleaning apparatus of the invention to be embodied in an assembly generally designated 10 and to include, among other things, a cabinet generally designated 12 and having disposed within the upper portion thereof, a sink assembly generally designated 14. The cabinet also preferably includes a front access door 13, and a safety cover 16, and left and right side pump control units 18,20. The cabinet 12 is shown to include upstanding sidewall portions such as the left hand sidewall 22, a front sink cover 24, and a lower recessed plate 26. Pedal units 28,30 are provided as portions of the pump control units 18,20. In the preferred form, first and second solvent discharge nozzles 32,34 are affixed respectively to the ends of spigots 36,38 each of which is attached to an associated fluid conduit 40,42, as will appear. A fitting 44 is provided to permit the entry of compressed "shop" air for actuating the unit. Hinge means shown at 46 in phantom lines, provide a pivotable connection between the fire safety cover 16 and the upper portion of the sink rear wall 48.

Referring now to FIG. 2, it is shown that the interior of the cabinet 12 is shown to include a shelf 50 supporting left and right solvent receptacles 52,54. FIG. 2 also shows that the sink assembly 14 includes tapered sidewalls 56, flat upper and outer marginal surfaces 58, a lower, solvent collection surface 60 and a drain assembly generally designated 62 and shown to include an inlet area 64, an outlet area 66. A fitting 68 provides connection for a drain outlet tube 70, the lowermost portion of which 72 is disposed within the interior of the used solvent receptacle 52.

FIG. 2 also shows that the cabinet rear wall 74 mounts a pair of identical air operated pump and motor assemblies 76,78, respectively. Since these units are substantially identical, only one will be described.

Referring to the first or left hand pump and motor unit 76, this unit is of a well known air operated type and is a combination air operated pump and motor of a commercially available kind. The unit operates in response to being supplied with a volume of compressed "shop" air, normally running at 20 to 40 p.s.i. The rotation of a driven element serves simply to actuate a diaphragm which draws solvent into the pump body 80 through a dip tube 82 and discharge the solvent under slight pressure into a conduit 84 which extends from the pump body 80 to a fitting 86. From here, the fluid passes through a flexible conduit 40, as shown in FIG. 1. The upper end portion of the conduit 40 passes through a slot 88 in the upper surface of the rear sink wall 48. A fitting 90 secures this conduit 40 to the spout 36 which, as pointed out above, terminates in the nozzle 32.

A feature of the invention which is advantageous in use is that the lower end 92 of the solvent dip tube 82 extends downwardly into the solvent container so that it is spaced just apart from the bottom of the used solvent container 52.

Referring again to the air supply for driving the motor, air passing through the inlet fitting 44 is preferably passed through a pressure regulator-filter assembly generally designated 94, and shown (FIG. 3), to include a collection chamber 96, an inlet tube 98, a pressure dial indicator and regulator assembly 100, and an air flow control tube 102, extending downwardly to the pedal control generally designated 18.

Referring again to FIG. 2, it will be .noted that the dip tube 104 from the right hand or second pump and motor assembly 78, has its lowermost end portion 106 terminating well above the bottom surface of the second solvent container 54.

Referring now to FIG. 4, another feature of the invention is shown; this includes the provision of a fire safety means in the form of a cover 16 and its attachment being a connection generally designated 110 to a cover support unit generally designated 112. As appears, the cover support stand 114 extends upwardly from a rigid mounting at the rear of the sink unit 14. At the upper end of the cover support 114, a chain or the like 116 is provided, with this chain connection 116 terminating in a generally rivit shape fusible link having its head portion 118 extending through and appearing on the front or operator side of the cover unit. When the link head 118 melts, support for the cover is lost and the cover closes by gravity over the sink top, containing or extinguishing any fire which may be present therein.

Referring now to the operation of the unit in the preferred form, it will be assumed that the unit is to be used for the first time.

In this case, the left hand or used solvent receptable 52 may be filled to one-half its capacity with solvent as indicated by the broken line L-1 in FIG. 2. The new solvent receptacle 54 may be filled entirely to its full or upper level L-2 as likewise shown in FIG. 2. Assuming that a spray gun is to be cleaned, the operator manipulates the left hand or first motor control assembly by depressing the pedal portion 28 with his foot to secure desired circulating action of the solvent in the first or left hand receptacle 52. This causes the pump and motor to be actuated, withdrawing solvent from the lower end 92 of the dip tube 82 and circulating it to the sink interior where it is discharged from the nozzle 32. The spray gun or other parts to be cleaned are rinsed with this solvent, which collects on the sink surface 60 and drains through the drain assembly 62 into the conduit 70 into the used solvent container. The operation continues until the spray gun appears visually to be substantially cleaned, at least to the point where the use of additional recirculated solvent will not perform further effective cleaning. Thereupon, the new or fresh solvent from the receptacle 54 is circulated and discharged through the nozzle 34 by manipulating the right hand control 20. This withdraws solvent from the lower portion 106 of the tube 104 and circulates it as described. This fresh solvent, used in a much smaller quantity, performs the "final" or last rinse cleaning of the inside and outside of the cup. When the inlet tube of the gun body is sealed against the discharge nozzle 34, and the pump and motor are actuated, solvent is forced under pressure through the internal ports of the gun body to clean it as well. The final rinse or rinses are performed with clean solvent after the unit is initially rinsed with used solvent. When solvent from the fresh solvent receptacle 54 is collected, it is also returned to the first or used solvent container 52. After a number of cleaning operations have been carried out, the solvent supply in the right hand or new solvent container 54 is depleted sufficiently that it falls to level L-3, that is, at or below the bottom of the dip tube 106. Further actuation of the pedal 28 will not result in circulation of further new solvent.

At this point, the used solvent container having been half filled initially, and half the solvent from the second container having been circulated through the sink and collected in the first container, the first container is filled with used solvent and the second receptacle contains half its capacity of still fresh solvent.

At this point, a service call is indicated. Performing the servicing operation on the machine is the utmost in simplicity. The access door 13 is opened and the used solvent receptacle, being substantially full and containing 5 gallons of solvent, for example, is removed from the machine. The former new solvent receptacle 54 is then neatly positioned on the left side of the shelf 50 and the dip tube and drain connections 82 and 70 are placed in association with it. The old receptacle filled with used solvent is removed from the premises and a new, entirely filled container is placed in the right hand side of the machine to serve as the new solvent receptacle 54. At this point, both receptacles include new solvent, but the half filled container 52 has its solvent recirculated periodically for rough cleanup as described above, being supplemented periodically with additions of new solvent taken from the receptacle 54. This again continues as described above.

Thus, each service call merely involves moving the new solvent container from one side of the machine to the other, and replenishing one full receptacle of dirty solvent with a full receptacle of clean solvent. Because the used or dirty solvent receptacle 52 always starts "clean" undue buildup of contaminance is unlikely.

While this mode of operation and service is not strictly required, it is an advantageous feature of the invention. Accordingly, the concommitant feature is the provision of the single sink drain emptying into the used receptacle which is provided with a true recirculating action, while the other receptacle provides a final rinse action only and is not adapted to receive recycled solvent. The foregoing arrangement provides good operator control.

As pointed out, these systems enable the user to take advantage of the recycling potential which is inherent in the outside surface concept. This extends not only to environmentally desirable treatment of solvent, but also to the economies of scale achieved by central recycling.

Referring again briefly to FIG. 4, the fire safety system is believed self-explanatory in that the fire in the sink interior melts the fusible link and permits the fire safety cover 16 to be closed over the top of the sink. A desirable feature consists of providing flexible upper conduits extending between the pump outlets and the spigot and nozzle provided for solvent direction. This permits the spigots to be mounted on the cover while the flexible conduit connection permits the cover to be closed any number of times without resistance and without damage to the apparatus. Desirably, the cover may be closed to impede solvent evaporation when the unit is not in active use.

It will thus be seen that the present invention provides an apparatus having a number of advantages and characteristics including those herein pointed out and other which are inherent in the invention.

We claim:

1. A readily serviceable apparatus for solvent cleaning spray guns, said apparatus comprising, in combination, a cabinet adapted to support a sink unit, a sink unit which includes a bottom wall with a drain opening therein, said sink unit being supported by a portion of said cabinet, first and second solvent receptacles positioned within said cabinet for ready removal by a service person, with said first solvent receptacle having an inlet opening in an upper portion thereof, a single drain conduit having one of its ends communicating with said drain opening in said sink bottom wall and its other end being arranged so as to communicate in use with the interior of said first receptacle through said inlet opening without impeding the ready removability of said first receptacle, means for withdrawing solvent from said first receptacle and for directing said solvent to the interior of said sink, said first withdrawing and directing means including a first solvent receptacle dip tube, a first pump, a first conduit extending between said first pump and said sink interior, a first discharge nozzle forming the end of said first conduit and being direct to said sink interior, and means adapted to actuate said first pump in response to the command of an operator, means for withdrawing solvent from said second container and for directing said solvent to the interior of said sink, said second withdrawing and directing means including a second solvent receptacle dip tube, a second pump and a second conduit extending between said second pump and said sink interior, a second discharge nozzle forming the end of said second conduit and being directed to said sink interior, and means adapted to actuate said second pump in response to the command of an operator, whereby actuation of said first pump acts to circulate solvent directly from said first receptacle to said sink and back to said first receptacle, whereby actuation of said second pump serves to direct solvent from said second container to said sink interior and then directly to said first solvent receptacle only, whereby all solvent from both receptacles is collected only by said first receptacle, regardless of whether said operator actuates said first or second pumps.

2. An apparatus as defined in claim 1 wherein said cabinet includes a transversely extending interior shelf for positioning said receptacle for ready removal.

3. An apparatus as defined in claim 1, wherein said cabinet includes at least one door which, when open, provides ready service access to said solvent receptacles, and when closed, prevents access to said receptacles.

4. An apparatus as defined in claim 1 wherein said second solvent receptacle dip tube has its lower end spaced substantially apart from the lower wall of said second solvent receptacle to limit the amount of solvent able to be withdrawn from said second container.

5. An apparatus as defined in claim 1, said apparatus further including a cover unit hingedly mounted to said cabinet or said sink for pivotal movement between open and closed positions, with said first and second conduits being flexible conduits having portions thereof secured to said cover unit, whereby movement of said cover unit will not damage said conduits.

6. An apparatus as defined in claim 1, wherein said actuating means for said first and second pumps comprise, respectively, first and second, pedal-operated pump controls.

7. An apparatus as defined in claim 6, wherein each of said pump controls is adapted for incrementally varying the rate at which said pumps operate, whereby said flow rates of solvent circulation may be controlled.

8. An apparatus as defined in claim 1, wherein said first and second pump comprise air operated pumps.

9. An apparatus as defined in claim 8, said apparatus further including means for directing compressed air from a source of compressed air to each of said pumps.

* * * * *